US006094782A

United States Patent [19]

Gay et al.

[11] Patent Number: 6,094,782

[45] Date of Patent: Aug. 1, 2000

[54] CLASP WITH UNFOLDING ARMS

[76] Inventors: Jacques Hubert Gay, 90, Route de Vandoeuvres, Vandoeurvres-Genéve CH-1253; Luigi Ferrario, 53, rue de la Marniére, Hauterive CH-2068, both of Switzerland

[21] Appl. No.: 09/066,309

[22] Filed: Sep. 14, 1998

[30] Foreign Application Priority Data

Aug. 27, 1996 [CH] Switzerland ..... 2080/96

[51] Int. Cl.[7] ..... A44C 5/24

[52] U.S. Cl. ..... 24/71 J; 24/68 J

[58] Field of Search ..... 24/68 J, 68 E, 24/68 T, 69 J, 70 J, 71 R, 71 J, 205 EC, 265 BC, 265 B, 616, 625

[56] References Cited

U.S. PATENT DOCUMENTS

| | | | |
|---|---|---|---|
| 5,187,838 | 2/1993 | Fontana | 24/71 J |
| 5,331,723 | 7/1994 | Mathieu | 24/71 J |
| 5,579,559 | 12/1996 | Ferrario | 24/71 J |
| 5,689,859 | 11/1997 | Cuche | 24/71 J |
| 5,711,056 | 1/1998 | Taguchi et al. | 24/71 J X |
| 5,829,104 | 11/1998 | Gay et al. . | |
| 5,857,243 | 1/1999 | Champion | 24/68 J X |

FOREIGN PATENT DOCUMENTS

| | | | |
|---|---|---|---|
| 0509938 A1 | 10/1992 | European Pat. Off. . | |
| 2705873 A1 | 12/1994 | France . | |
| 187578 | 6/1906 | Germany | 24/71 J |
| 256629 | 8/1948 | Switzerland | 24/71 J |
| 649205 | 5/1985 | Switzerland | 24/71 J |
| 661609 | 11/1951 | United Kingdom | 24/71 J |
| WO96/31138 | 10/1996 | WIPO . | |
| WO97/17861 | 5/1997 | WIPO . | |

*Primary Examiner*—Anthony Knight
*Assistant Examiner*—Robert J. Sandy
*Attorney, Agent, or Firm*—Oppedahl & Larson LLP

[57] ABSTRACT

The invention relates to a folding clasp having at least one folding arm (1, 2) articulated with respect to a base plate (3), with a locking means (4) located on the base plate (3), permitting a locking of said at least one folding arm (1, 2) by pressing said folding arm (1, 2) onto said locking means (4), said locking means (4) being compressible and/or deformable in a first plane (TT') parallel to a base surface of said locking means (4).

18 Claims, 9 Drawing Sheets

CLASP WITH UNFOLDING ARMS

Figure 1A:
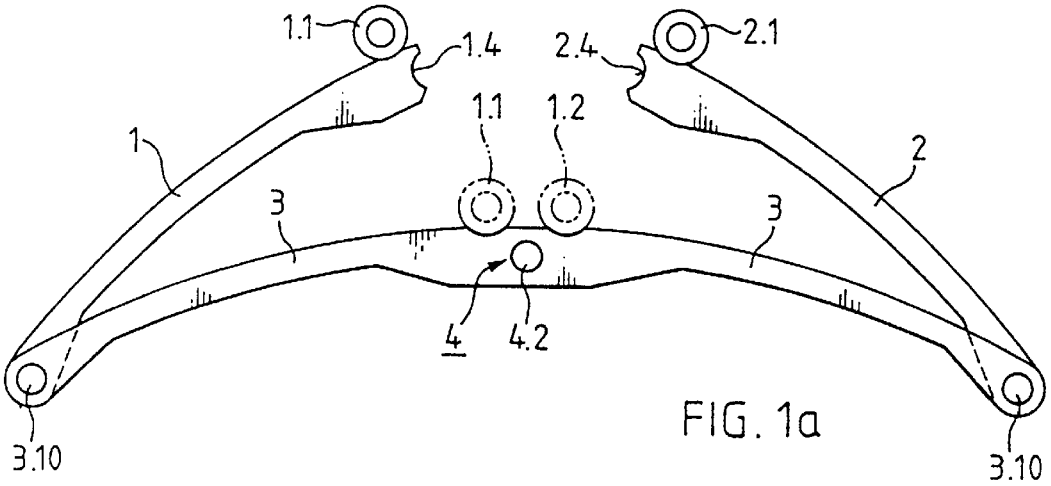

The invention relates to a clasp, particularly a folding clasp in accordance with the claims. It more specifically relates to a folding clasp for a wrist-watch with at least one folding arm which can be locked on an elastic locking means located in a base plate.

EP-509,938 discloses a folding clasp comprising two folding arms articulated at the ends of a central cover or stretcher. Each arm has a concavity permitting locking by compressing said concavity on a rod or pin of the central cover. The arms are in one piece and have limited elasticity and the concavities lose their flexibility under the effect of a repeated compression. In order to correct this flexibility loss, the width of the concavity can be modified by deforming a groove placed behind the concavity with the aid of a screwdriver or knife tip. This flexibility modification is not very reliable and there is a risk of the folding arm being destroyed.

EP-115,740 discloses another folding, snap-on clasp with a tuning fork system and having a more stable construction, with large friction surfaces for the notching of the folding arms. Mention is made of the significant amount of force necessary for closing or opening the strap. This constitutes another disadvantage, because the user may damage his nails on activating the nail-groove.

A third disadvantage relates to the reliability and security of the known folding, sap-on clasp fasteners. It is difficult to regulate the locking forces and there is a risk of an untimely opening of the folding clasp. In exemplified manner mention is made of the problem of the asymmetry of the snap-on force of a clasp having two folding arms closing on a common stud. During a first notching of one of the folding arms said stud is slightly deformed, resulting in a differentiated snap-on force of the notching of the other folding arm.

The significant costs of known folding clasps represent a fourth disadvantage, particularly due to the high precision required during the manufacture of elements requiring special tools and irreversible connections of the different elements of the clasp. The prevents any replacement of the elements and also frequently a subsequent dismantling of said clasp.

A fifth disadvantage is the lack of long-term stability of the known, snap-on, folding clasp fasteners. The fastening of the different elements are often subject to highly disadvantageous effects such as corrosion, so that there is a risk of the folding claps breaking.

A sixth disadvantage results from the use of identical materials, such as stainless steel on stainless steel, so that there is a danger of jamming when specific pressures become high. From the mechanical standpoint it is not appropriate to effect a snap-on action using identical materials. The ideal situation would be to use a pair of materials differing by the molecular structure and a hardness difference.

Therefore, the object of the present invention is to provide a solution to these problems by creating a generally applicable, folding clasp, e.g. for a wrist-watch, which has a particularly compact construction compatible with known, proven manufacturing methods.

This object is achieved by the invention as defined in the claims.

Figure 1B:
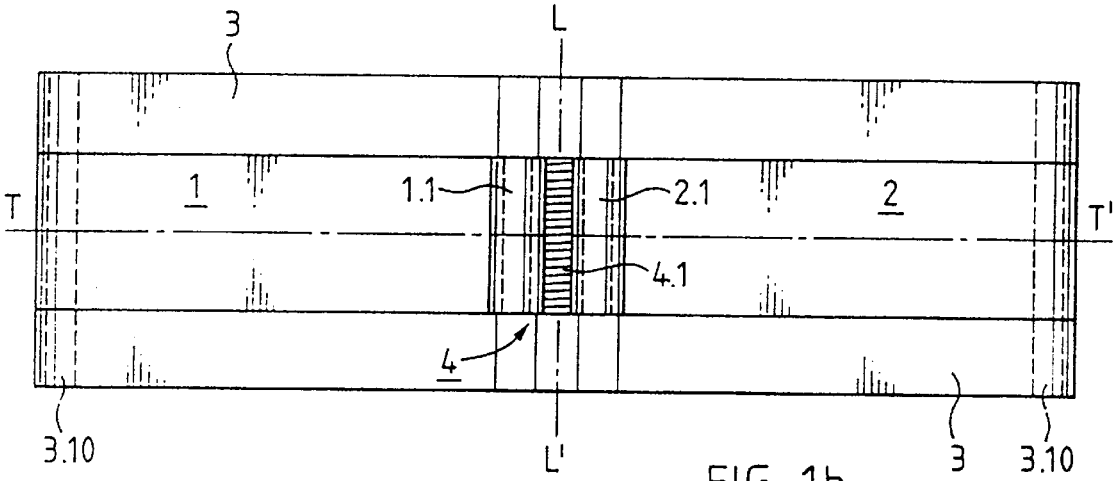
Figure 2A:
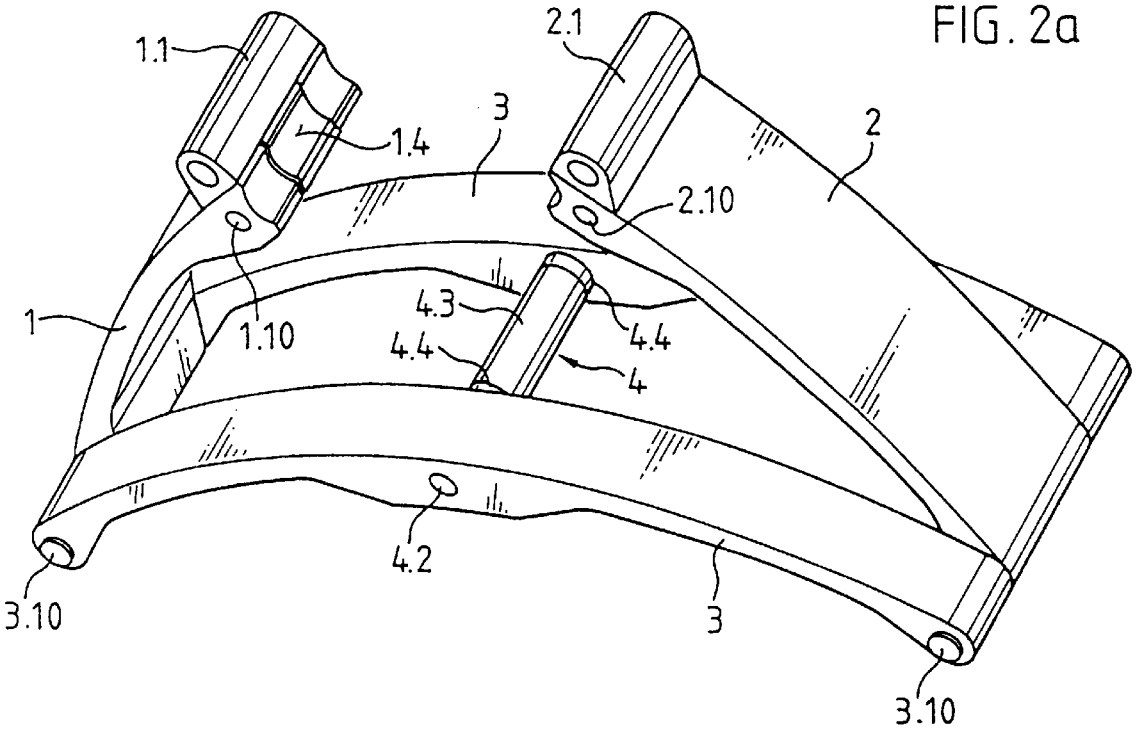
Figure 2B:
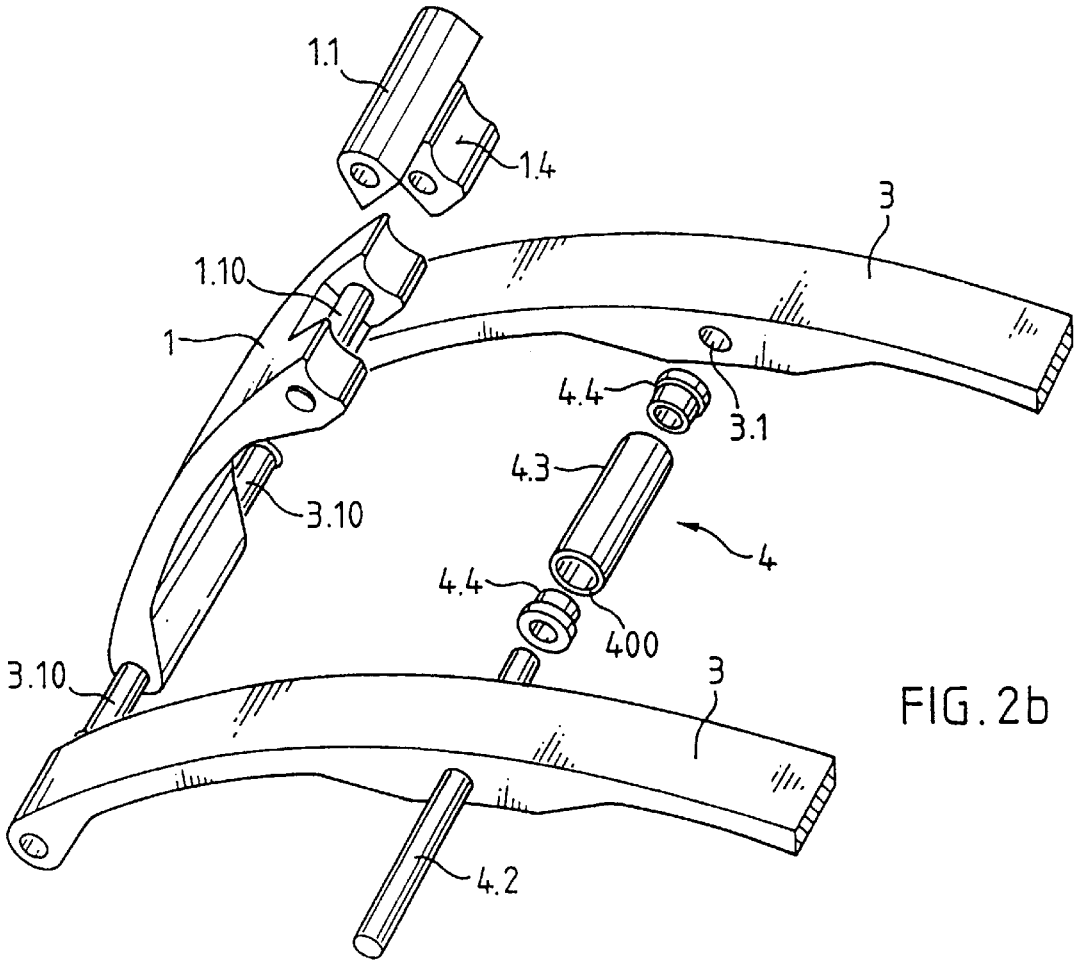
Figure 3A:
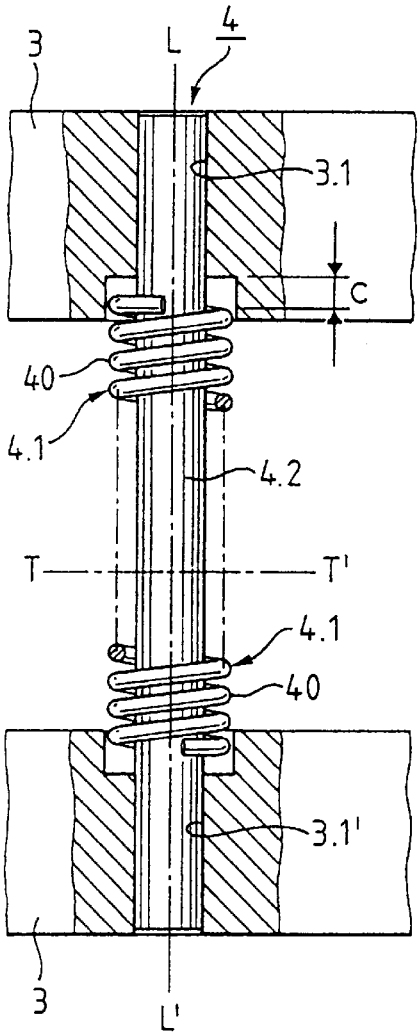
Figure 3B:
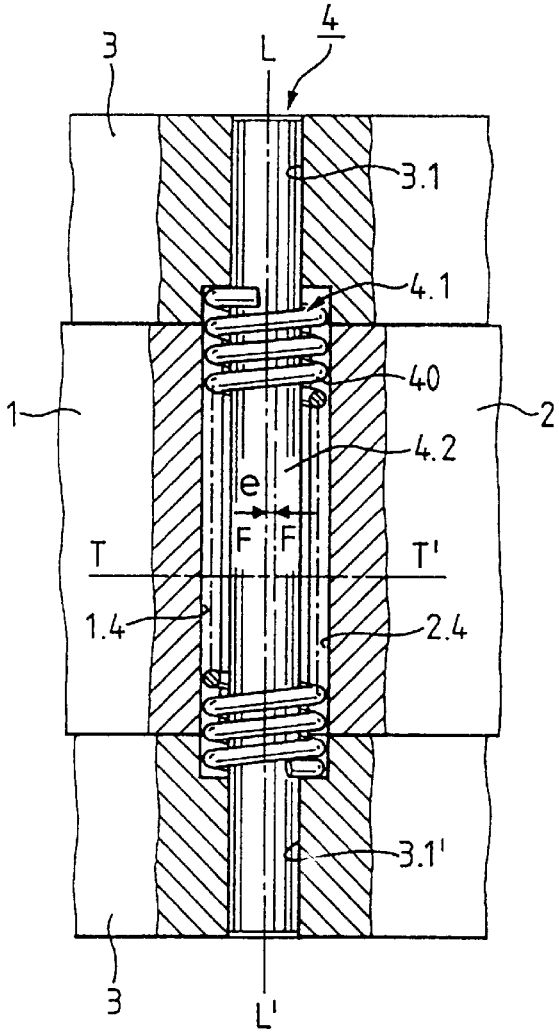
Figure 4:
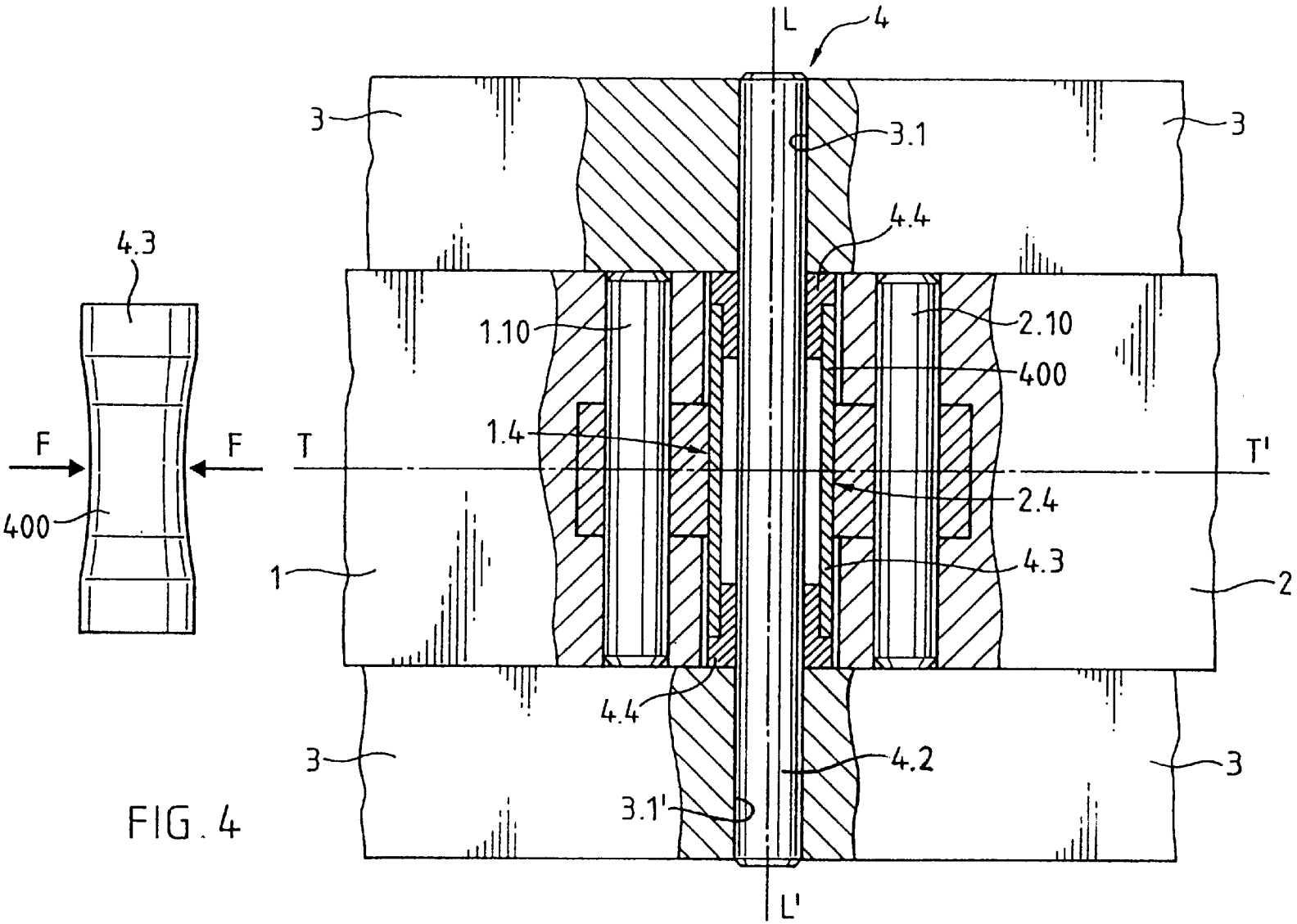
Figure 5:
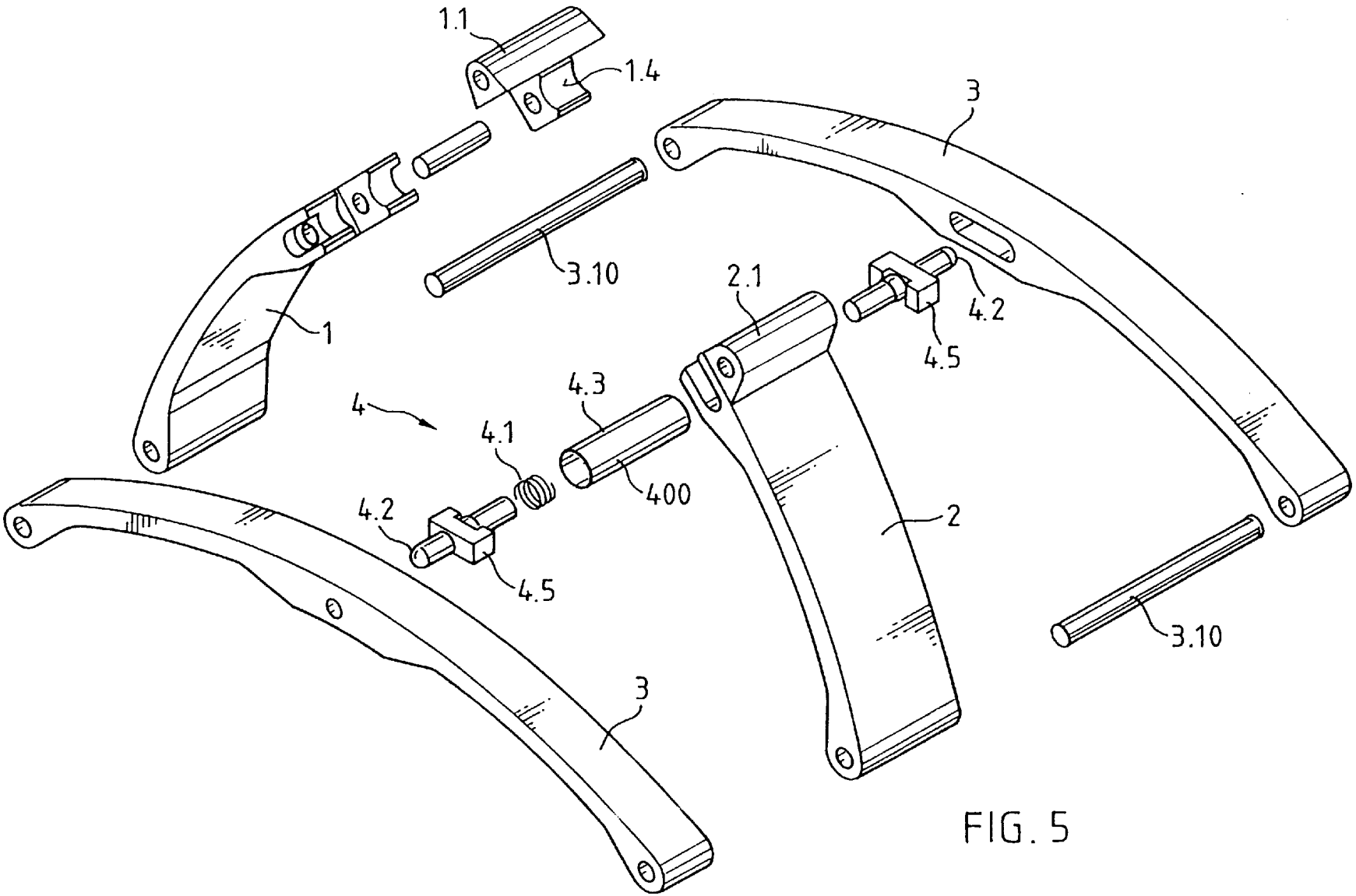
Figure 6:
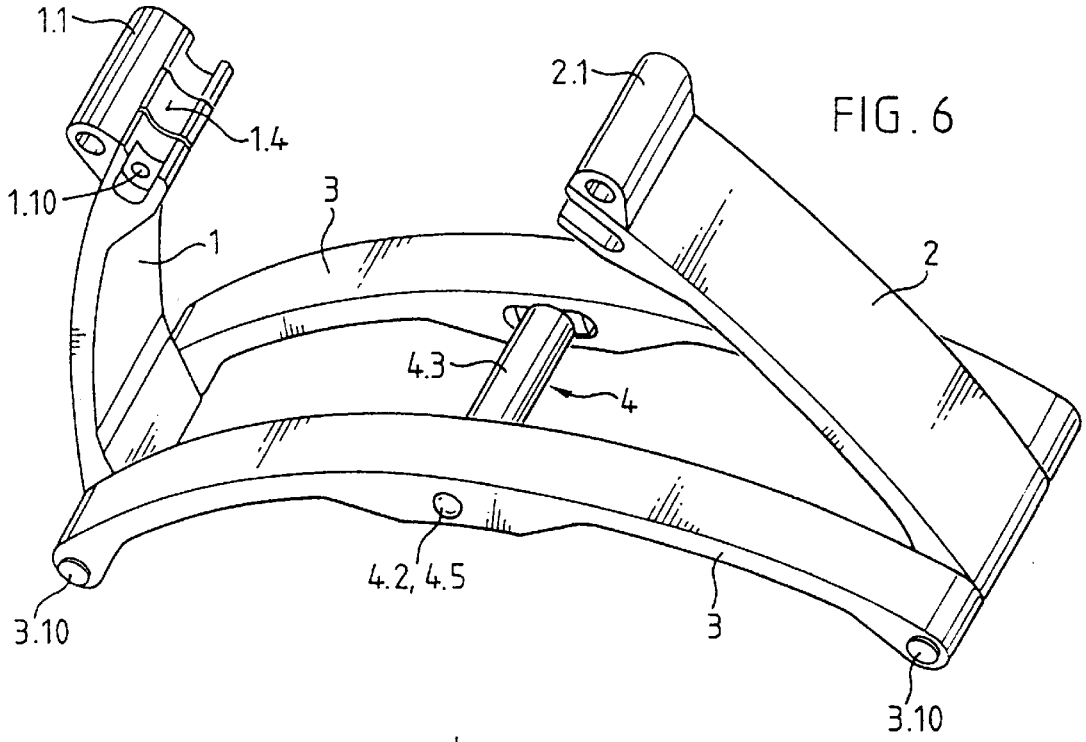
Figure 7:
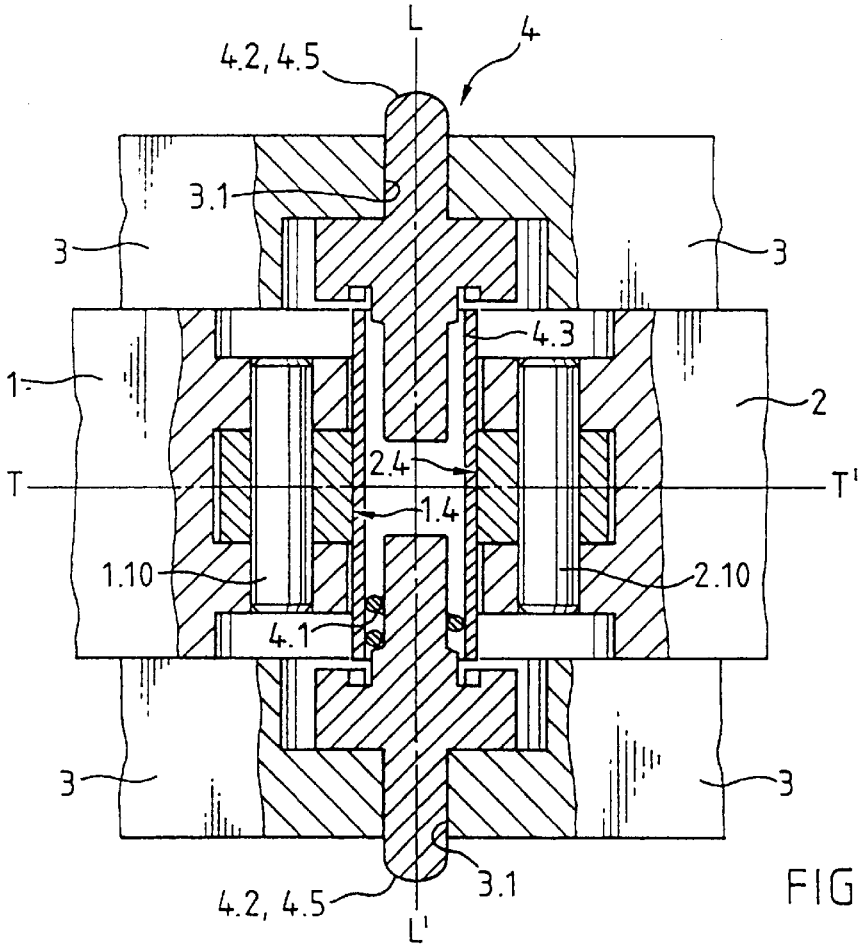
Figure 8:
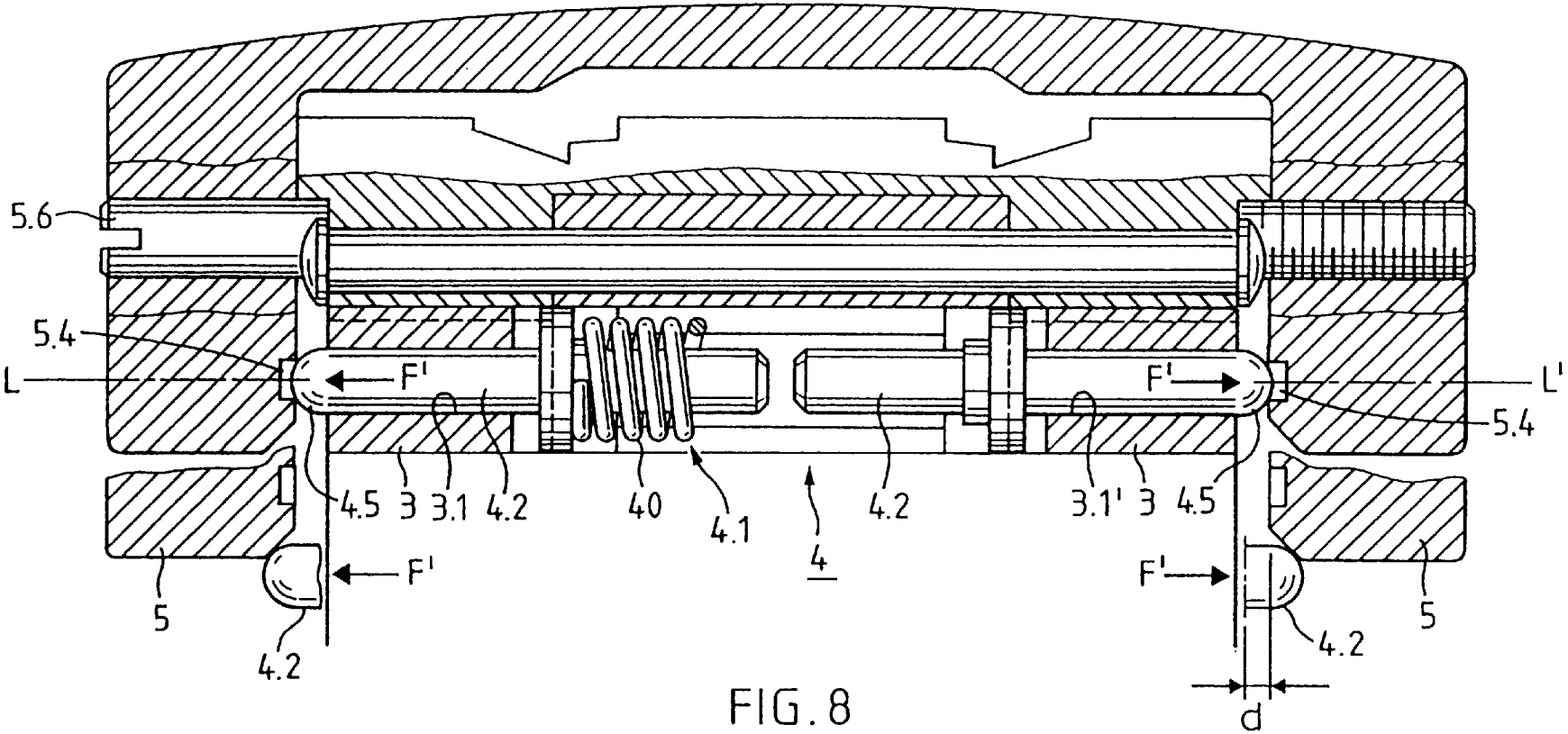
Figure 9A:
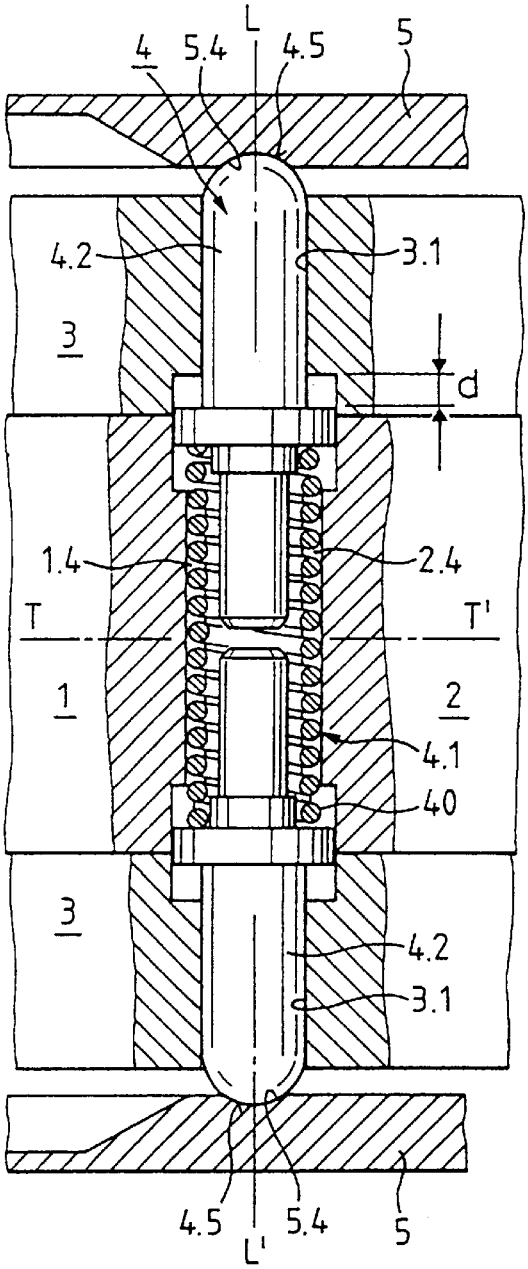
Figure 9B:
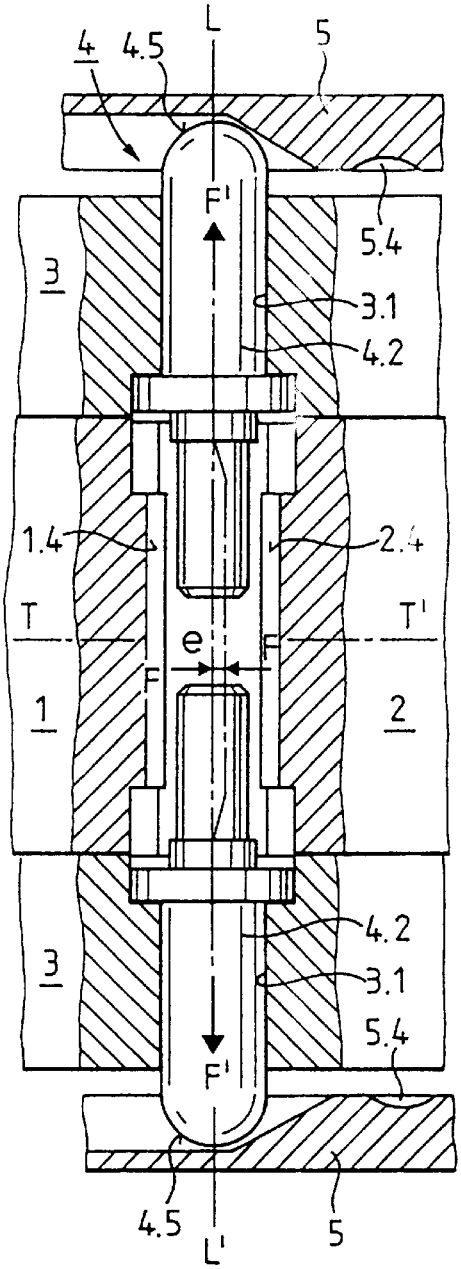
Figure 10:
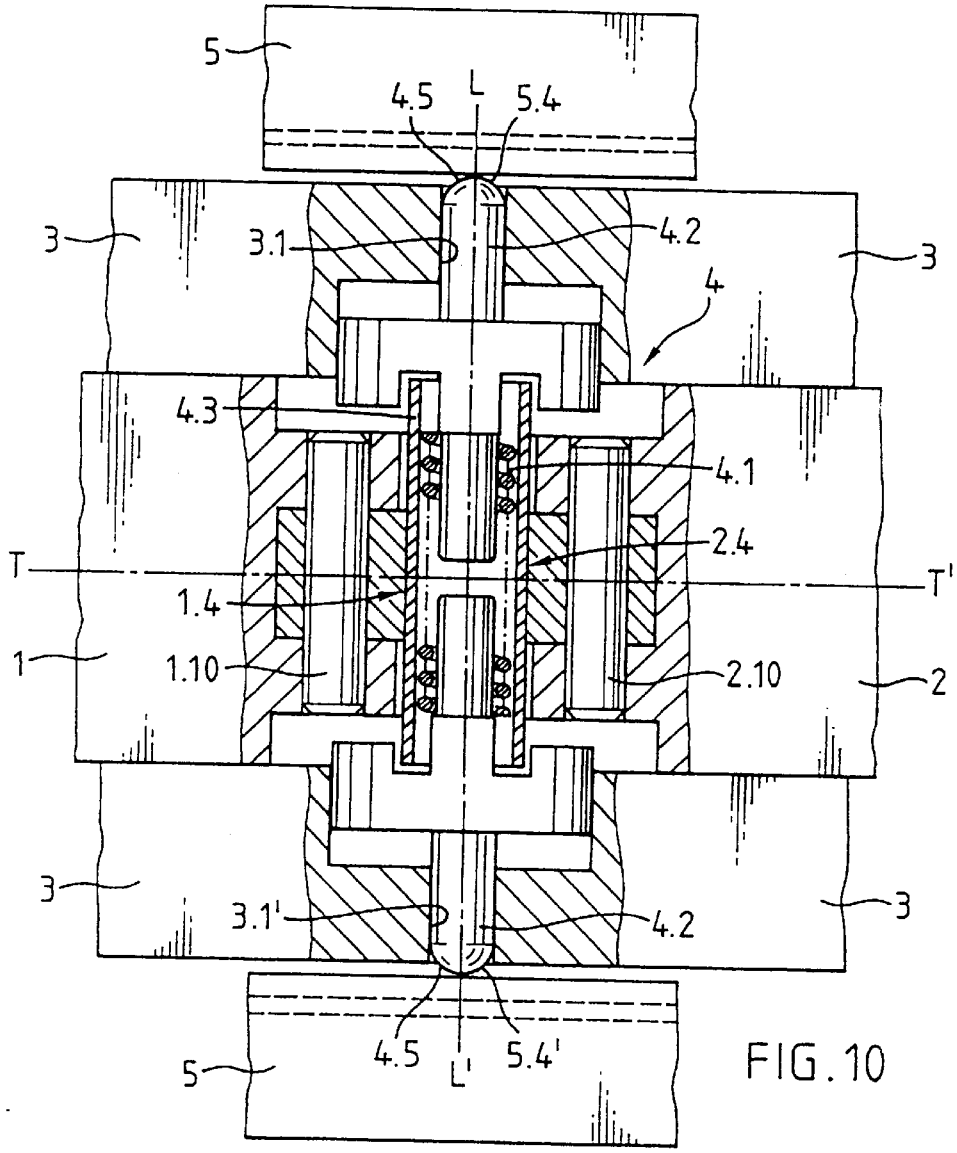
Figure 11:
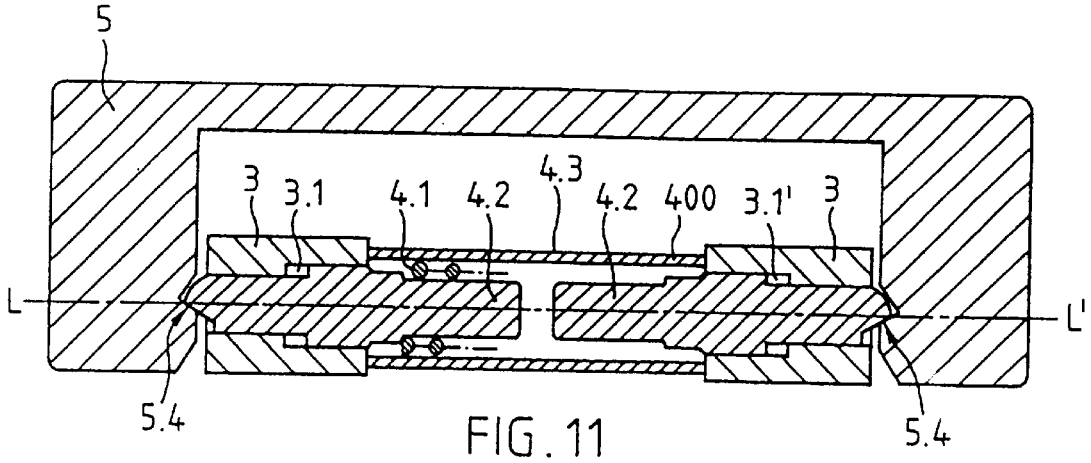

The invention will be described relative to the attached drawings, wherein show:

| | |
|---|---|
| FIGS. 1a and 1b | A side and plan view of a detail of a first, preferred embodiment of a folding clasp according to the invention, showing the folding arms, a base plate and an elastic locking means incorporating a coil or spiral spring. |
| FIGS. 2a and 2b | A side and plan view of a detail of a second, preferred embodiment of a folding clasp according to the invention, showing the folding arms, a base plate and an elastic locking means incorporating an elastic tube. |
| FIGS. 3a and 3b | A plan view, partly in section, of a detail of the first, preferred embodiment of the locking means for a folding clasp according to FIGS. 1a and 1b, showing a compression of the elastic locking means in a first transverse plane. |
| FIG. 4 | A plan view, partly in section of a detail of the second, preferred embodiment of the locking means of a folding clasp according to FIGS. 2a and 2b showing a deformation of the elastic locking means in a first transverse plane. |
| FIG. 5 | An exploded view of a detail of a third, preferred embodiment of a folding clasp according to the invention showing the folding arms, a base plate and an elastic locking means incorporating a coil spring and/or an elastic tube. |
| FIG. 6 | A side and plan view of a detail of a fourth, preferred embodiment of a folding clasp according to the invention showing the folding arms, a base plate and an elastic locking means incorporating a tube and a coil spring. |
| FIG. 7 | A plan view, partly in section, of a detail of the fourth, preferred embodiment of the locking means of a folding clasp according to FIG. 6 showing a compression/deformation of the elastic locking means in a first transverse plane and in a second longitudinal plane. |
| FIG. 8 | A side view, partly in section, of a detail of a fifth, preferred embodiment of the locking means of a folding clasp according to the invention showing the folding arms, a base plate, an elastic locking means incorporating a coil spring and a security locking device of a security means. |
| FIGS. 9a and 9b | Plan views, partly in section, of a detail of a fifth, preferred embodiment of the locking means of a folding clasp according to FIG. 8, showing a compression of the elastic locking means in a first transverse plane and a second longitudinal plane. |
| FIG. 10 | A plan view, partly in section, of a detail of a sixth, preferred embodiment of the locking means of a folding clasp according to the invention showing the folding arms, a base plate, an elastic locking means incorporating a tube and a coil spring and a security locking device of the security means, the elastic locking means being compressed/deformed in a first transverse plane and a second longitudinal plane. |
| FIG. 11 | A side view, partly in section, of a detail of a fifth, preferred embodiment of the locking means of the folding clasp according to FIG. 10. |

The visible elements of the folding clasp according to the invention are preferably metallic and are e.g. made from stainless steel and/or gold. However, it is obviously possible to sue other basic materials. The folding clasp comprises at least one folding arm 1, 2 articulated with respect to a base strip or plate 3 and a locking means 4. According to the preferred embodiments shown in FIGS. 1*a* to 11, the base plate 3 is formed by two edge plates linked by two base pins 3.10. According to said preferred embodiments, said base pins 3.10 also serve as a hinge for the two folding arms 1, 2. Preferably, fasteners 1.1, 2.1 positively engaging on the folding arms 1, 2 permits the fixing of a watch-strap to the folding clasp, said fasteners 1.1, 2.1 e.g. permitting the fixing of a link strap. It is e.g. possible to provide terminal links jointly forming part of a link strap and the folding claps. Such terminal links extend beyond the scope of the present invention and are not shown in the drawings.

The said locking means 4 is firmly fixed in at least one opening 3.1, 3.1' of the base plate 3. Said locking means 4 permits a locking of said at least one folding arm 1, 2 by pressing down the latter onto the locking means 4. Each folding arm 1, 2 comprises at least one contact surface 1.4, 2.4 which can bear in compression or reversible deformation on the locking means 4. Said locking means can be compressed or deformed in a first plane TT' parallel to its base surface and/or in a second plane LL' transversely to its base surface. Six preferred embodiments of a folding clasp according to the invention are shown:

FIGS. 1*a,* 1*b,* 3*a* and 3*b* show a first, preferred embodiment of a folding clasp with compression in a first plane TT' of a locking means 4 with a coil spring 4.1 and a core 4.2.

FIGS. 2*a,* 2*b* and 4 show a second, preferred embodiment of a folding clasp with deformation in a first plane TT' of a locking means 4 with an elastic tube 4.3 and a core 4.2.

FIG. 5 shows a third embodiment of a folding clasp with compression in a first plane TT' and a second plane LL' of a locking means 4 with a coil spring 4.1 and/or elastic tube 4.3 and two cores 4.2.

FIGS. 6 and 7 show a fourth embodiment of a folding claps with compression/deformation in a first plane TT' and a second plane LL' of a locking means 4 with a coil spring 4.1, two cores 4.2 and an elastic tube 4.3.

FIGS. 8, 9*a* and 9*b* show a fifth embodiment of a folding clasp with compression in a first plane TT' and a second plane LL' of a locking means 4 with a coil spring 4.1 and two cores 4.2.

FIGS. 10 and 11 show a sixth embodiment of a folding clasp with compression/deformation in a first plane TT' and a second plane LL' of a locking means 4 with a coil spring 4.1, two cores 4.2 and an elastic tube 4.3.

Said locking means 4 comprises several elastic elements and combinations of said elastic elements. In the preferred embodiments according to FIGS. 1*a,* 1*b,* 3*a,* 3*b,* 5 to 11, the locking means 4 comprises a coil spring 4.1 and at least one core 4.2 serving as a support and fixture in the base plate 3 to said coil spring 4.1. The coil spring 4.1 is arranged around said at least one core 4.2 permitting a compression of the coils 40 in a first plane TT' and approaching them to said at least one core 4.2 and a compression of the coils 40 in a second plane LL' by sliding on said at least one core 4.2. At least one contact surface 1.4, 2.4 of at least one folding arm 1, 2 bears on the locking means 4 compressing at least one portion of an end of said locking means 4 oriented in the first plane TT' of said locking means 4. The interaction surfaces of the folding arms 1.4, 2.4 with the coil spring 4.1 extend over the entire width of said coil spring 4.1. FIGS. 3*a,* 3*b,* 9*a,* 9*b* show the compression by a distance e in the plane TT' of the coils 40 of said locking means 4 under the effect of a closure force F. The coils 40 of the coil spring 4.1 and flexible, become oval and can be displaced, so as to permit a self-centering a compensation of a possible asymmetry in the alignment of the folding arms, 1, 2 with respect to the locking means. This closure is accompanied by an expansion of the coils 40 of the coil spring 4.1 on the exterior of the core 4.2. FIGS. 3*a* and 3*b* show the expansion by a distance c in the plane LL' of the locking means 4 under the effect of the closure force F.

In other preferred embodiments according to FIGS. 2*a,* 2*b,* 4 to 11 the locking means 4 comprises an elastic tube 4.3 and at least one core 4.2. Said elastic tube 4.3 has a thin wall 400 serving as interaction portions and permitting a reversible deformation. Under the effect of a closure force F, the thin wall 400 can be deformed and the elastic tube 4.3 becomes oval. This deformation more particularly takes place in the central portion of the elastic tube 4.3, because the ends of said elastic tube 4.3 are fixed in the base plate 3. The contact surfaces 1.4, 2.4 of the folding arms 1.2 can bear in reversible deformation on the elastic tube 4.3, being adapted as regards shape and width to said deformation of the central portion of such an elastic tube 4.3. As the width of the interaction surface with the folding arms 1, 2 is reduced by more or less than half compared with the interaction surface of the coil spring 4.3 with the folding arms 1, 2, there is a reduction of the prejudicial effects of a possible asymmetry in the alignment of the folding arms 1, 2 with respect to the locking means 4.

The elastic tube 4.3 is preferably metallic and its thin wall 400 preferably has a thickness of 0.15 mm. For a smaller thickness, the maximum bending stress would become excessive (the deformation force being too high and snapping on becoming difficult), whereas for a greater thickness the elastic constant of the elastic tube 4.3 becomes too high (the thin wall 400 deforming beyond the reversible yield strength and the snapping-on effect not being adequately pronounced). Thus, for an elastic tube 4.3 manufactured from a metallic material, e.g. a stainless steel tube 4.3, a thickness of 0.15 mm represents an ideal choice, permitting both a clearly defined snapping on a closure force (which is adequately felt, without being either too great or too small), whilst guaranteeing an easy machining of the locking means 4.

Without passing beyond the scope of the present invention, it would consequently be possible to directly fix said elastic tube 4.3 in the base plate 3. In principle, such an elastic tube 4.3 has no need for a core. However, the use of at least one core 4.2 is preferred, because it leads to an increase in the stability and reliability of the fixing of said elastic tube 4.3 in the base plate 3. In order to permit a deformation of the elastic tube 4.3 in its central portion, the external diameter of said at least one core 4.2 must be smaller than the internal diameter of the elastic tube 4.3. In order to bring about a fixing of the ends of said elastic tube 4.3 to said at least one core 4.2, crosspieces 4.4 can be provided for connecting said elastic tube 4.3 to said at least one core 4.2.

With the knowledge of the present invention, the expert can vary said closure force F by numerous different means. It is e.g. possible to combine a coil spring 4.1 with an elastic tube 4.3, as is shown in other preferred embodiments according to FIGS. 5 to 7, 10 and 11. Preferably, said coil spring 4.1 is placed on or around one of two cores 4.2 and the said elastic tube 4.3 is placed around said coil spring 4.1. This leads to the advantages that the coil spring 4.1 is virtually completely hidden, thus complying with esthetic requirements, whilst still holding the folding clasp, because the coils 400 can be prejudicial to the appearance of the folding clasp (depending on the taste of customers and fashion) and the coils 400 and in particular the interstices cannot be dirty (although easy to clean).

The opening of the locked folding clasp takes place by pressing at least one portion of one end 4.5 of at least one core 4.2 in order to compress the coil 40 of a coil spring 4.1 and/or for deforming the thin wall 400 of an elastic tube 4.3 oriented in the second plane LL' of the locking means 4, so as to deactivate the locking of the contact surfaces 1.4, 2.4 of the folding arms 1, 2 with the locking means 4. The compressed coils 40 and deformed thin wall 400 through said at least one core 4.2 exert an opening force on the contact surfaces 1.4, 2.4 of the folding arms 1, 2 and make it possible to open the folding claps. The user is able to unlock the folding clasp simply by pushing the ends 4.5 of at least one core 4.2 passing beyond the side walls of the base plate 3, preferably with the flat ends of two fingers, so that the nails are not damaged on activating a nail-groove.

It is consequently possible to sue a folding clasp according to the invention having a locking means 4 with as its elastic elements either a coil spring 4.1, or an elastic tube 4.3 and/or a combination of a coil spring 4.1 with an elastic tube 4.3. On pivoting the two folding arms 1, 2 towards the base plate 3, it is necessary to compress the coils 40 of a coil spring 4.1 and/or the thin wall 400 of the elastic tube 4.3 in a transverse manner by the contact portions 1.4, 2.4 or concave ends of the folding ends 1, 2 in order to be able to close the folding arms 1, 2 by snapping on and expansion of the coils 40 of a coil spring 4.1 or by reversible deformation of the thin wall 400 of an elastic tube 4.3 in the ends in the form of concavities of the folding arms 1, 2. FIGS. 3*a,* 3*b* and 9*a,* 9*b* show the compression by a distance e of a locking means 4 in the form of a coil spring 4.1 under the effect of the closure force F. FIG. 4 shows the deformation of a locking means 4 in the form of an elastic tube 4.3 under the effect of the closure force F.

The main difference in the elastic means 4.1, 4.3 of the locking means 4 used according to the invention relates to the manner in which such an elastic element 4.1, 4.3 compensates such a closure force F:

The coils 40 of a coil spring 4.1 are flexible, become oval and can be displaced on one or two cores 4.2 serving for fixing purposes in the base plate 3. Thus, the coils 40 permit a self-centering and a compensation of a possible asymmetry in the alignment of the folding arms 1, 2 with respect to the locking means 4. The closure of the folding arms 1, 2 is accompanied by an expansion of the coils 40 on the outside of the core 4.2. The interaction between the folding arms 1, 2 and the coil spring 4.1 takes place over the entire width of said coil spring 4.1.

The thin wall 400 of an elastic tube 4.3 can be defomred and becomes oval. This deformation more particularly takes place in the central portion of the elastic tube 4.3, because its ends are fixed (directly or indirectly) in the base plate 3. The contact surfaces 1.4, 2.4 of the folding arms 1.2 can bear in reversible deformation on said elastic tube 4.3, being adapted as regards shape and width to the deformation of the central portion of such an elastic tube 4.3. In view of the reduced width of the interaction surface with respect to the coil spring 4.1, the prejudicial effects of a possible asymmetry in the alignment of the folding arms 1, 2 with respect to the locking means 4 are of a minimum nature.

A combination of an elastic tube 4.3 with a coil spring 4.1 arranged on one or two cores 4.2 permits both a self-centering and a compensation of a possible asymmetry in the alignment of the folding arms 1, 2 with respect to the locking means 4 and a deformation limited to the central portion of the elastic tube 4.3. The coil spring 4.1 is almost completely hidden, thereby complying with esthetic requirements, whilst still permitting an easy holding action of the folding clasp.

Another advantage of the present invention results directly from the use of a single locking means 4, permitting regualtion of the closure force F, whilst replacing one or more elements of said locking means 4. The male and female models differ only by the spring force or elasticity. The folding clasp permits a rapid change to the closure force F on replacing the locking means 4. For this purpose, it is obviously possible to use locking means 4 having different closure forces F. This can take place by choosing a slightly larger or smaller diameter for the locking means 4 or by using coils 40 of a coil spring 4.1 or a thin wall 400 of an elastic tube 4.3 having a more or less pronounced elasticity.

The folding clasp according to the invention can comprise a security means 5 being arranged in articulated manner with respect to a folding arm 1, 2 and permitting a security locking of said at least one folding arm 1, 2 by pressing down said security means 5 on said locking means 4. Said security means 5 comprises at least one contact surface 5.4 able to bear in compression in a second plane LL' on the locking means 4. FIGS. 8 to 11 show that the security means 5 is preferably in the form of a cover. This cover is detachably fixed to a not shown, terminal link forming part of a watch-strap and the folding clasp. A pin 5.6 serves as a hinge for said fastening. With the knowledge of the present invention, the expert can obviously arrive at other arrangements for the security means with respect to the folding clasp.

According to the preferred embodiments shown in FIGS. 8 to 11, at least one contact surface 5.4 of at least one security means 5 bears on the locking means 4, whilst pressing at least one portion of an end 4.5 of at least one core 4.2 and compressing the coils 40 of a coil spring 4.1 oriented in the second plane LL' of the locking means 4. FIGS. 8, 9*a* and 9*b* show an embodiment of a folding clasp with a locking means 4 having a coil spring 4.1 and two cores 4.2, FIGS. 10 and 11 showing an embodiment of a folding clasp with a locking means 4 having a coil spring 4.1, two cores 4.2 and an elastic tube 4.3.

Said security locking takes place by pivoting the security means 5 in the form of a cover towards the folding arms 1, 2. At least one portion of an end 4.5 of at least one core 4.2 is pressed and the coils 40 of a coil spring 4.1 are longitudinally compressed by the interior of the contact portions or notches 5.4 of the lateral security arms 5, so as to be able to close the cover by snapping on and expansion of the coils 40 in the notches 5.4 within the lateral security arms 5. FIGS. 8, 9*a* and 9*b* show two stages of such a security fastener F'. They show the compression by a distance d in plane LL' of the locking means 4 under the effect of the security force F'. When the coils 40 touch, they are compressed more, bringing about an additional security force F' over and beyond the closure force F. However, said security force F' remains smaller than the opening force of the folding clasp, thus permitting a security locking without undoing the locking of the folding arms 1, 2.

The folding clasp according to the invention permits the closure of the folding arms 1, 2 and a security locking of said fastener. The use of the secrity means 5 in the form of a cover according to FIGS. 8 to 11 remains optional.

The folding clasp is constructed with a minimum number of elements, having a considerably symmetry and stability, guaranteeing reliable opertion and easy holding. Said at least one folding arm 1, 2 and said security means 5 are preferably machined as one-piece metal item. In exemplified manner, FIG. 2*b* shows a preferred embodiment of a folding arm 1, 2 and a fastener 1.1, 2.1 connected by positive engagement with the aid of a pin 1.10, 2.10. This permits an easy machining and rapid variation of the appearance of the folding clasp. As the fastener 1.1, 2.1 is used for the fixing of a watch-strap, a shape change with respect to the strap and the links does not require a replacement of the compete folding arms 1, 2, but merely requires a replacement of the fasteners 1.1, 2.1.

An additional advantage is the avoidance of welding. In view of the high precision required for an easy, repeated actuation of the clasp and in view of the technical difficulties encountered during the treatment of the chosen materials (reduction of hardness during welding, asymmetrical deformation during welding), it has been found to the advantageous to avoid welding for the fixing of the fasteners 1.1, 2.1 to the folding arms 1, 2. With the knowledge of the present invention, the expert will be able to implement other fixing means for other base materials e.g. heat melting for heat-meltable, synthetic materials, et.

The locking means 4 is preferably metallic. It has been found advantageous to choose a coil spring 4.1 or elastic tube 4.3 from a different material (e.g. Nivaflex, Phynox, etc.) compared with the steel of the folding arms 1, 2 and base plate 3, which guarantees a good friction coefficient. The use of a pair of materials differing by their molecular structure and hardness is ideal. The use of the tuning fork system of the clasp according to the invention with stainless steel folding arms 1, 2 and coil springs 4.1 and elastic tubes 4.3 made from a different materials leads to considerably snapping on variations, because the elasticity of the stainless steel is not constant and its chemical composition is not that of a coil spring or an elastic tube. Unlike in the case of known clasps, which do not use such a pair of different materials, it is possible to obtain identical snapping on forces on the two folding arms. The use of other base materials is obviously possible and not limited by the invention.

The folding clasp according to the invention is preferably used for the opening and closing of a watch-strap by a locking means 4 firmly fixed to said folding clasp.

What is claimed is:

1. A folding clasp having two folding arm (1, 2) articulated with respect to a base plate (3), characterized in that one and only one locking means (4) having a base surface is place don the base plate (3), permitting a locking of said folding arms (1, 2) by turning down said folding arms (1, 2) onto said locking means (4) and said locking means (4) can be compressed and/or deformed in reversible manner in a first plane (TT') parallel to the base surface of said locking means (4).

2. A folding clasp having at least one folding arm (1, 2) articulated with respect to a base plate (3), characterized in that a locking means (4) having a base surface is placed on the base plate (3), permitting a locking of said at least one folding arm (1, 2) by turning down said folding arm (1, 2) onto said locking means (4) and said locking means (4) can be compressed and/or deformed in reversible manner in a first plate (TT') parallel to the base surface of said locking means (4). Characterized in that the locking means (4) comprises a coil spring (4.1) comprising coils (40) and at least one core (4.2) and said coil spring (4.1) is arranged around said at least one core (4.2), permitting a compression of the coils (40) in the first plane (TT') moving them towards the core (4.2).

3. The folding clasp according to claim 2, characterized in that said coil spring (4.1) is arranged around said at least one core (4.2), permitting a compression of the coils (40) in a second plane (LL') transversely to the base surface of said locking means (4) by the sliding of the coils (40) on the core (4.2).

4. The folding clasp according to claim 2, characterized in that said coil spring (4.1) is fixed in the base plate through said at least one core (4.2).

5. A folding clasp having at least one folding arm (1, 2) articulated with respect to a base plate (3), characterized in that a locking means (4) having a base surface is place on the base plate (3), permitting a locking of said at least one folding arm (1, 2) by turning down said folding arm (1, 2) onto said locking means (4) and said locking means (4) can be compressed and/or deformed in reversible manner in a first plane (TT') parallel to the base surface of said locking means (4). Characterized in that the locking means (4) comprises an elastic tube (4.3) having a thin wall (400), permitting a deformation of the thin wall (400) in the first plate (TT').

6. The folding clasp according to claim 5, characterized in that the elastic tube (4.3) is fixed through at least one core (4.2) in the base plate (3).

7. The folding clasp according to claim 6, characterized in that the elastic tube (4.3) is fixed by its ends to said at least one core (4.2) and that crosspieces (4.4) can be provided for connecting said elastic tube (4.3) to said at least one core (4.2).

8. The folding clasp according to claim 6, characterized in that the external diameter of said at least one core (4.2) is smaller than the internal diameter of said elastic tube (4.3) and that the elastic tube (4.3) is deformed in its central portion.

9. A folding clasp according to claim 5, characterized in that the locking means (4) further comprises a coils spring (4.1) comprising coiled (40) and at least one core (4.2), that said coiled spring (4.1) is placed on or around said at least one core (4.2), that said elastic tube (4.3) is placed around said coil spring (4.1) so that the latter is almost completely hidden, whilst permitting a compression of the coils (40) and a deformation of the thin wall (400) in the first plane (TT').

10. The folding clasp according to claim 1, characterized in that the locking means (4) is firmly fixed in at least one opening (3.1, 3.1') of the base plate (3).

11. The folding clasp according to claim 1, characterized in that the locking means (4) is metallic.

12. The folding clasp according to claim 1, characterized in that each of said two folding arms (1, 2) comprises at least one contact surface (1.4, 2.4) able to bear in compression and/or deformation on the locking means (4).

13. The folding clasp according to claim 12, characterized in that said at least one contact surface (1.4, 2.4) of each of said two folding arms (1, 2) bears on the locking means (4) compressing and/or deforming at least one portion of an end oriented in the first plane (TT') of the locking means (4).

14. The folding clasp according to claim 5, further comprising a coil spring (4.1) comprising coils (40), characterized in that said coil spring (4.1) is arranged around at least one core (4.2), permitting a compression of the coils (40) in a second plane (LL') transversely to the base surface of said locking means (4) by the sliding of the coils (40) on the core (4.2), characterized in that said folding arm (1.2) comprises at least one contact surface (1.4, 2.4) able to bear in compression and/or deformation on the locking means (4), characterized in that the folding clasp is unlocked by pressing at least one portion of an end (4.5) of at least one core (4.2) and compressing the coils (40) and/or deforming the thin wall (400) of the elastic tube (4.3) oriented in the second plane (LL') of the locking means (4) in order to deactivate the locking of the at least one contact surface (1.4, 2.4) of said at least one folding arm (1, 2) relative to the locking means (4).

15. A folding clasp having at least one folding arm (1, 2) articulated with respect to a base plate (3), characterized in that a locking means (4) having a base surface is placed on the base plate (3), permitting a locking of said at least one folding arm (1, 2) by turning down said folding arm (1, 2) onto said locking means (4) and said locking means (4) can be compressed and/or defomred in reversible manner in a first plane (TT') parallel to the base surface of said locking means (4). Characterized in that a security means (5) is placed in articulated manner with respect to said at least one folding arm (1,2), permitting a security locking of said at least one folding arm (1,2) by turning down said security means (5) on said locking means (4) and that the locking means (4) can be compressed in a second plane (LL') transversely to its base surface.

16. The folding clasp according to claim 15, characterized in that at least one contact surface (5.4, 5.4') of at least one security means (5) bears on the locking means (4) compressing at least one portion of an end (4.5) of at least one core (4.2) oriented in the second plane (LL') of the locking means (4).

17. The folding clasp according to claim 15, characterized in that said security means (5) is a cover machined as a one-piece metal item.

18. The folding clasp according to claim 1, characterized in that said two folding arms (1, 2) are machined as one-piece metal items and that a fastener (1.1, 2.1) for fixing a watch-strap is connected to each folding arm (1, 2) by positive engagement.

* * * * *

UNITED STATES PATENT AND TRADEMARK OFFICE

CERTIFICATE OF CORRECTION

PATENT NO : 6,094,782

DATED : August 1, 2000

INVENTOR(S) : Jacques Hubert Gay, et al.

It is certified that error appears in the above-identified patent and that said Letters Patent are hereby corrected as shown below: On the title page:

[30] should include International Application No. PCT/CH97/00148, filed April 15, 1997.

[73] should reflect the Assignee as follows:

Montres Rolex S.A.
3-7, Rue Francois-Dussaud
CH-1211 Geneva 24, Switzerland

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*